US011224106B2

(12) United States Patent
Murthy

(10) Patent No.: US 11,224,106 B2
(45) Date of Patent: Jan. 11, 2022

(54) SYSTEMS, METHODS AND APPARATUS FOR COMPENSATING ANALOG SIGNAL DATA FROM A LUMINAIRE USING AMBIENT TEMPERATURE ESTIMATES

(71) Applicant: SIGNIFY HOLDING B.V., Eindhoven (NL)

(72) Inventor: Abhishek Murthy, Arlington, MA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/634,280

(22) PCT Filed: Jul. 17, 2018

(86) PCT No.: PCT/EP2018/069362

§ 371 (c)(1),
(2) Date: Jan. 27, 2020

(87) PCT Pub. No.: WO2019/020431

PCT Pub. Date: Jan. 31, 2019

(65) Prior Publication Data

US 2021/0092819 A1 Mar. 25, 2021

Related U.S. Application Data

(60) Provisional application No. 62/537,521, filed on Jul. 27, 2017.

(30) Foreign Application Priority Data

Aug. 29, 2017 (EP) ..... 17188310

(51) Int. Cl.

| | |
|---|---|
| ***H05B 45/10*** | (2020.01) |
| ***H05B 47/11*** | (2020.01) |
| ***H05B 47/19*** | (2020.01) |

(52) U.S. Cl.
CPC ..... *H05B 47/11* (2020.01); *H05B 45/10* (2020.01); *H05B 47/19* (2020.01)

(58) Field of Classification Search
CPC ..... H05B 47/10; H05B 47/105; H05B 47/11; H05B 47/13; H05B 47/19; H05B 45/10
See application file for complete search history.

(56) References Cited

U.S. PATENT DOCUMENTS

| | | | | |
|---|---|---|---|---|
| 5,870,022 | A | 2/1999 | Kuhnly et al. | |
| 6,288,395 | B1 * | 9/2001 | Kuhnly | G08B 13/19 250/252.1 |

(Continued)

FOREIGN PATENT DOCUMENTS

| | | | |
|---|---|---|---|
| CN | 103970961 | A | 8/2014 |
| JP | 2004213955 | A | 7/2004 |
| JP | 2008034190 | A | 2/2008 |

*Primary Examiner* — Thai Pham

(57) ABSTRACT

The described embodiments relate to system, methods, and apparatuses for compensating sensor data from a luminaire based on an ambient temperature estimate that is generated from operating characteristics of the luminaire. The sensor data can be provided from a sensor, such as a passive infrared sensor, that is connected to the luminaire, and by compensating the sensor data, more accurate metrics can be generated from the sensor data. For instance, the compensated sensor data can be used to generate occupancy metrics that can be used as a basis for controlling a network of luminaires or other devices that can be influenced by occupants of an area. The compensated sensor data can also be used to calibrate the sensor.

15 Claims, 5 Drawing Sheets

(56) References Cited

U.S. PATENT DOCUMENTS

| | | | | |
|---|---|---|---|---|
| 2003/0136908 | A1 | 7/2003 | Pfister et al. | |
| 2006/0197452 | A1 | 9/2006 | Zhang | |
| 2012/0026726 | A1* | 2/2012 | Recker | F21V 21/0824 362/157 |
| 2015/0055680 | A1 | 2/2015 | Remor et al. | |
| 2015/0102226 | A1 | 4/2015 | Monaci et al. | |
| 2015/0208490 | A1* | 7/2015 | Bishop | H05B 47/115 315/153 |
| 2016/0172904 | A1 | 6/2016 | Recker et al. | |
| 2016/0300479 | A1 | 10/2016 | Modi et al. | |
| 2016/0323958 | A1* | 11/2016 | Chemel | H05B 47/105 |
| 2017/0231061 | A1* | 8/2017 | Deese | G06K 9/4652 |
| 2019/0242760 | A1 | 8/2019 | Chen | |

* cited by examiner

SYSTEMS, METHODS AND APPARATUS FOR COMPENSATING ANALOG SIGNAL DATA FROM A LUMINAIRE USING AMBIENT TEMPERATURE ESTIMATES

CROSS-REFERENCE TO PRIOR APPLICATIONS

This application is the U.S. National Phase application under 35 U.S.C. § 371 of International Application No. PCT/EP2018/069362, filed on Jul. 17, 2018, which claims the benefit of European Patent Application No. 17188310.1, filed on Aug. 29, 2017 and U.S. Provisional Patent Application No. 62/537,521, filed on Jul. 27, 2017. These applications are hereby incorporated by reference herein.

TECHNICAL FIELD

The present disclosure is directed generally to processing sensor data from one or more luminaires. More particularly, the various embodiments relate to systems, methods, and apparatuses for compensating analog signal data according to estimates of ambient temperature.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some lighting devices can incorporate sensors for collecting data about an environment of the lighting devices. However, by incorporating such sensors, the lighting devices can become more susceptible to malfunction. Furthermore, adding components to a device can increase the amount of labor involved in manufacturing the lighting devices. As a result, there may be less ways to improve the functionality of a lighting device without incorporating additional parts that can potentially cause more issues.

SUMMARY

The present disclosure is directed to systems, methods, and apparatuses for providing compensated sensor data using estimates of ambient temperature that are generated from certain operational characteristics of a luminaire. In some implementations, a method implemented by one or more processors is set forth. The method can include steps such as causing a network of luminaires to operate according to an operating setting. The luminaire in the network of luminaires can include a light emitting diode (LED) array and a passive infrared sensor. The method can further include determining at least one operating characteristic of the LED array at least based on the operating setting of the luminaire, and determining a temperature estimate from the at least one operating characteristic of the LED array. The temperature estimate can be associated with an environment of the network of luminaires. The method can further include receiving, from the passive infrared sensor of the luminaire, an analog signal corresponding to thermal radiation from the environment of the network of luminaires, and generating a compensated response signal from the analog signal using the temperature estimate. The temperature estimate can correspond to an ambient temperature of the luminaire and the method can further include determining an estimate of a number of occupants in the environment from the compensated response signal. The at least one operating characteristic can be a real-time measurement of power consumption of the LED array. Furthermore, determining the at least one operating characteristic includes determining an LED junction temperature for the LED array. The at least one operating characteristic can be a real-time measurement of thermal resistance at a heat sink of the luminaire. In some implementations, the method can include causing a separate passive infrared sensor of a different luminaire to be calibrated based on the temperature estimate.

In yet other embodiments, a system is set forth as including a network of luminaires, one or more processors, and memory configured to store instructions that, when executed by the one or more processors, cause the one or more processors to perform steps that include receiving operating characteristic data from one or more luminaires in the network of luminaires. The operating characteristic data can include a variable that is different than temperature. The steps can further include receiving analog signal data from one or more passive infrared sensors connected to the network of luminaires, and generating an estimate of ambient temperature from at least the operating characteristic data. Additionally, the steps can include operating the network of luminaires based on compensated analog signal data that can be generated from the analog signal data and the estimate of ambient temperature. The steps can also include determining an estimate of occupancy of an area associated with the ambient temperature using the compensated analog signal data. The operating characteristic data can be a forward-bias voltage of a light emitting diode (LED) array of the one or more luminaires. In some implementations, the steps can include generating, based on the compensated analog signal data, an estimate of occupancy rate, occupancy total, or occupancy distribution for an area illuminated by the network of luminaires. The network of luminaires can be operated further based on the occupancy rate, the occupancy total, or the occupancy distribution of the area illuminated by the network of luminaires.

In yet other implementations, a computing device (600), illustrated in FIG. 6, is set forth as including a light emitting diode (LED) array (602), a sensor (604) configured to provide an analog response signal, one or more processors (606), and memory (608). The memory can be configured to store instructions that, when executed by the one or more processors, cause the one or more processors to perform steps that include generating the analog response signal according to an external stimulus from an environment of the LED array. The steps can further include determining one or more operating characteristics of the LED array. The one or more operating characteristics can be associated with a luminance of the LED array. The steps can also include generating an estimate of an environmental metric based on at least an operating characteristic, generating a compensated analog response signal based on the estimate of the environmental metric, and modifying the one or more operating characteristics at least based on the compensated analog response signal. The one or more operating characteristics can include at least a dimming level of the LED array. The environmental metric can be an ambient temperature and the one or more operating characteristics can include a forward-bias voltage or a forward-bias current of the LED array. The external stimulus can include infrared radiation from one or more occupants of the environment illuminated by the LED array.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "lighting fixture" or "luminaire" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller, which employs one or more microprocessors that may be programmed using software (e.g., machine code) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or machine code) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g., for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
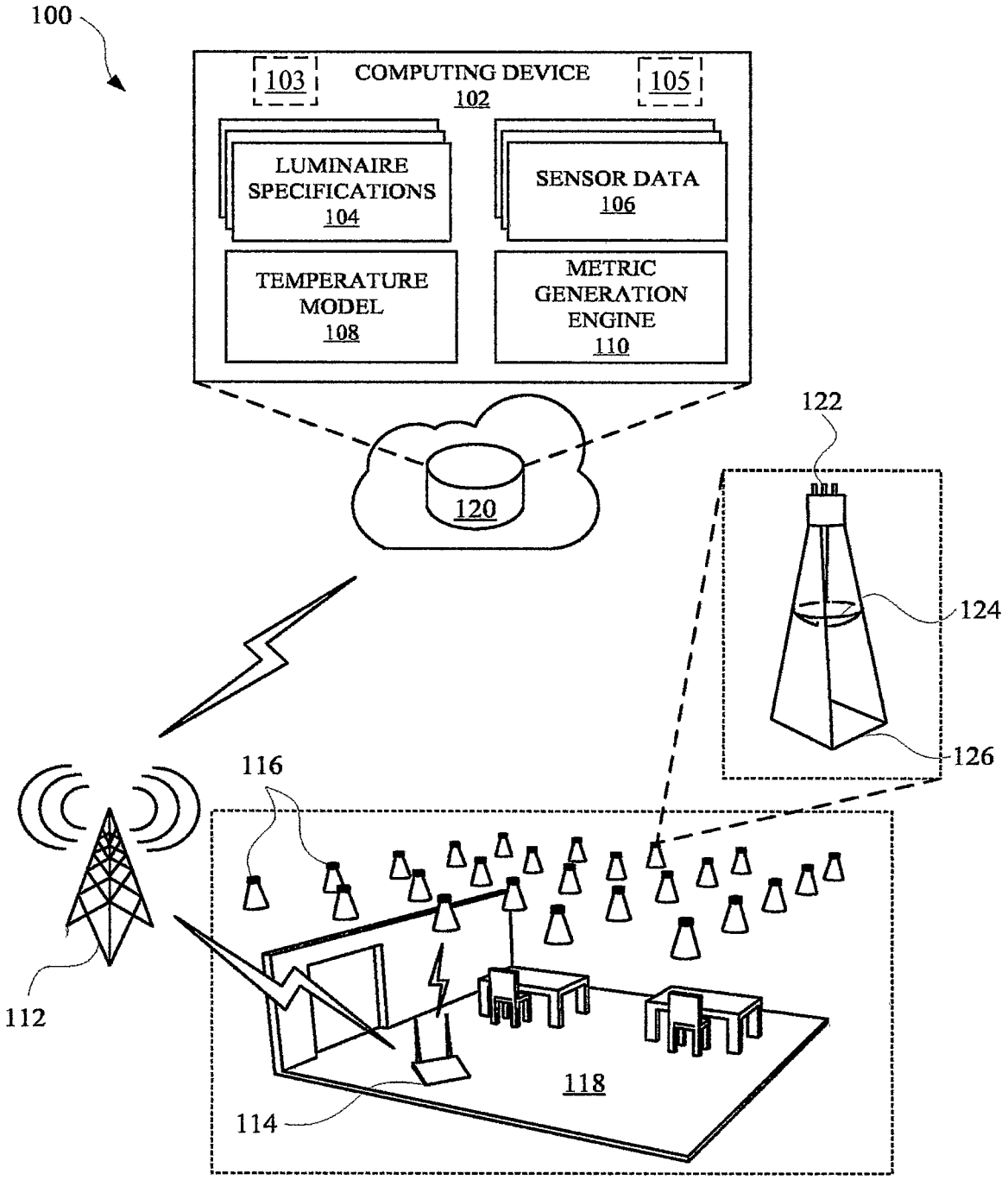
FIG. 1 illustrates a system for providing compensated sensor data in order to generate accurate metrics related to an environment of a luminaire.

The described embodiments relate to systems, methods, and apparatuses for compensating analog signals using operating characteristics of a circuit in order to generate more accurate data related to operations of a luminaire. Specifically, the embodiments provided herein relate to compensating analog signals from a passive infrared sensor using an estimate of ambient temperature. The estimate of ambient temperature can be generated from operating characteristics of circuitry in the luminaire.

Passive infrared sensors can be incorporated into a variety of different lighting devices and lighting systems. For instances, some passive infrared sensors can be employed by lighting systems in order to generate occupancy related data, such as estimates of how many people are in an area illuminated by a lighting system. Furthermore, a location of a person can be estimated using multiple passive infrared sensors to triangulate a location of the person. Typically, in order to provide such estimates, analog signals from the passive infrared sensors are converted into binary form. However, converting the analog signals into binary form can remove the analog response of the passive infrared sensors, rendering the binary form of the analog signals inaccurate.

Analog responses of passive infrared sensors can be used to generate several metrics about a location such as, for example, occupant localization, occupancy estimates, and space optimization. The analog response of a passive infrared sensor can depend on a variety of factors, including ambient temperature. For instance, the amplitude of the analog response can be proportional to a difference between the temperature of an object and an ambient temperature around the object. Therefore, compensating an analog response signal using an estimate of ambient temperature can improve the accuracy of data generated from the analog response signal, especially compared to binary versions of the signal. However, incorporating a temperature sensor into a luminaire to track ambient temperature may not be effective for improving luminaire operations. For example, adding another sensor to the luminaire can add more steps to manufacturing the luminaire and create other mechanisms by which the luminaire can malfunction.

In order to compensate an analog response of a passive infrared sensor without incorporating designated temperature sensors, existing circuitry of a luminaire can be used for generating estimates of ambient temperature. Specifically, operating characteristics of the circuitry can be used as a basis for estimating ambient temperature at or near the luminaire. In some instances, an ambient temperature measurement can be generated from a thermal inverse model that converts operating power and/or forward-bias voltage to the ambient temperature. The forward-bias voltage can be calculated by dividing the power of a lighting emitting diode (LED) array by a product of dimming level and nominal forward-bias current. The forward-bias voltage can then be used to calculate a junction temperature of the LED array, which can then be used to estimate the ambient temperature. Estimating ambient temperature from junction temperature can involve using variables such as heat sink thermal resistance, LED package resistance, and total number of LEDs. In this way, ambient temperature can be estimated without the need for an additional sensor, and therefore analog responses of the passive infrared sensor can be compensated for existing luminaires. For instance, the peak-to-peak voltage and/or gain of the passive infrared sensor can be calibrated based on the ambient temperature so that metrics generated from the ambient temperature can be more accurate.

FIG. 1 illustrates a system 100 for providing compensated sensor data in order to generate accurate metrics related to an environment of a luminaire. Sensors can be connected to luminaires in order that certain environmental metrics can be generated from sensor data. However, when sensor data is converted from analog to binary form, data related to an analog response of a sensor is typically lost, resulting in any subsequent metrics generated from the binary data being inaccurate. Moreover, the analog response can be rendered inaccurate by certain environmental conditions such as, for example, temperature. The system 100 overcomes these issues with sensor data collection by using estimates of certain environmental conditions to compensate the sensor data without employing additional environmental sensors.

In some implementations, a network of luminaires 116 are connected to a gateway device 114 as part of a local area network of a building 118. Each luminaire 116 can include a controller (i.e., computing device) that is connected to one or more sensors (e.g., a passive infrared sensor) for collecting data about the operation of the luminaires 116 and/or an environment of the luminaires 116. For instance, a luminaire 116 can include a passive infrared sensor 122 that can collect data for determining an occupancy of the building 118. The passive infrared sensor 122 can monitor an area 126, which can correspond to a path through which people can move. In some implementations, the passive infrared sensor 122 can be connected to a lens 124 (e.g., a Fresnel lens) to modify a focal length of the passive infrared sensor 122.

Data collected at the luminaires 116 can be transmitted through the gateway device 114, or a network 112 (e.g., the Internet), to a remote device 120. The remote device 120 can be a computing device 102, which can be implemented by one or more processors 103 and memory 105, for collecting, storing, and/or processing sensor data 106 collected by the sensors of the luminaires 116 in the building 118.

The computing device 102 can also store luminaire specifications 104, which can be used by the computing device 102 to create one or more temperature models 108. A temperature model 108 can be employed by the computing device 102 to determine how a particular luminaire 116 is affected by temperature, or any other environmental condition. For instance, an ambient temperature of the building 118 can affect the sensor data 106 from a passive infrared sensor of each luminaire 116. Specifically, an amplitude of the analog response of the passive infrared sensor can be proportional to the difference between the temperature of an object and the ambient temperature around the object. Therefore, employing a temperature model 108 that compensates the sensor data using the ambient temperature can improve the accuracy of the passive infrared sensor.

The temperature model 108 can compensate the sensor data 106 using estimates of ambient temperature that are based on the luminaire specifications 104 and/or other sensor data 106. For instance, an amount of power consumed by the luminaire 116 can be measured at the luminaire 116 or otherwise estimated from a source that is external to the luminaire 116 (e.g., utility data). A value for power $P_{LED}$ can be used to estimate a value for forward-bias voltage of an LED in a luminaire 116. In some implementations, an equation for estimating the forward-bias voltage $V_f^{est}$ can include Equation (1) below, where $P_{LED}$ is the operating power of an LED array of the luminaire 116, 1 is a dimming level of the luminaire 116, and $I_f^{nom}$ is a nominal forward-bias current of the LED array.

$$V_f^{est} = \frac{P_{LED}}{l * I_f^{nom}} \tag{1}$$

In some implementations, the nominal forward-bias current can be a measured value or an estimated value. Moreover, because the nominal forward-bias current can be affected by a temperature of the luminaire 116, the nominal forward-bias current can provide a suitable basis from which to calculate an estimate for ambient temperature. The forward-bias voltage estimated at Equation (1) can be used to estimate a junction temperature $T_j^{est}$ from a nominal junction temperature $T_j^{nom}$. For instance, Equation (2) below can be solved in order to provide the junction temperature estimate $T_j^{est}$.

$$V_f^{est} = V_f^{nom} + \frac{dV_f}{dT_j}(T_j^{est} - T_j^{nom}) \tag{2}$$

The parameter $$\frac{dV_f}{dT_j}$$

can be provided in the luminaire specifications 104 in order to compensate the difference between the junction temperature estimate and the nominal temperature estimate. Furthermore, the nominal junction temperature $T_j^{nom}$ can be provided in the luminaire specifications 104 or otherwise provided from an external source capable of determining a nominal temperature at the luminaire 116. The temperature model 108 can use Equation (3) to estimate the ambient temperature, at least based on the junction temperature estimate $T_j^{est}$.

$$T_j^{est} = T_a + (R_{th\ b\text{-}a} \times m \times I_f \times V_f) + (R_{th\ j\text{-}sp} \times I_f \times V_f) \tag{3}$$

In Equation (3), $R_{th\ b\text{-}a}$ and $R_{th\ j\text{-}sp}$ can be thermal resistances of a heat sink of the luminaire 116 and an LED package thermal resistance. For instance, $R_{th\ b\text{-}a}$ can be a thermal resistance measured from the LED package to the ambient environment, and $R_{th\ j\text{-}sp}$ can be thermal resistance measured from a solder pad or thermal pad to an LED junction. The thermal resistance values can be provided from the luminaire specifications 104 and/or any other source of operational specifications for a luminaire. The value m can represent a total number of LEDs in the luminaire 116. The variable $T_a$ can be the ambient temperature, which can be solved in order that a metric generation engine 110 of the computing device 102 can use the ambient temperature in order to compensate sensor data 106 to generate metrics associated with the operations of the luminaires 116.

An example scenario for evaluating Equations (1)-(3) can include a luminaire that includes 48 LEDs in series, thereby making value "m" from Equation (3) equal to 48. The parameter $$\frac{dV_f}{dT_j}$$

of Equation (2) can be equal to −2.4, a value that can be provided in an LED data sheet. The heat sink thermal resistance value $R_{th\ b\text{-}a}$ can be 0.5, and the junction to solder pad thermal resistance $R_{th\ j\text{-}sp}$ can be equal to 6. Additionally, according to this example, the nominal junction temperature $T_j^{nom}$ can be 85 degrees Celsius. If the measured value for $V_f$ is 2.9 V, then according to Equation (2), the value for $T_j^{est}$ is 85.1667 degrees Celsius. Furthermore, at least based on these values, the ambient temperature $T_a$ can be 42 degrees Celsius. As the luminaire ages, the value for $V_f$ can change, therefore a model that predicts $V_f$ over time can improve the estimates of ambient temperature.

In some implementations, the ambient temperature can be used, e.g., by the metric generation engine 110, to compensate an analog signal from a passive infrared sensor of the luminaire 116. The ambient temperature can affect a peak-to-peak voltage of the analog signal, therefore compensating for the ambient temperature can result in a more accurate signal from the passive infrared sensor. The peak-to-peak voltage can be used to characterize a distance of an object moving through the area 126 according to a given operating gain of the passive infrared sensor 122. In some implementations, the operating gain of the passive infrared sensor 122 can be adjusted based on the ambient temperature estimate in order that the passive infrared sensor will report more accurate values. For instance, the gain can be adjusted by the computing device 102 as part of a periodic calibration that is performed on the luminaries 116. In some implementations, multiple sensors can be used for triangulation in order to determine an exact location of one or more occupants of the building 118.

The compensated analog signal can thereafter be used by the metric generation engine 110 to provide estimates related to total occupancy (i.e., a total number of people) in a room or building, occupancy patterns, occupancy rates, energy movement, thermal efficiency, and/or any other metric that can be calculated using passive infrared sensor data. Furthermore, the compensated analog signal can be used for calibrating the passive infrared sensor 122. For instance, the compensated analog signal can provide a basis for calibrating a peak-to-peak voltage of the passive infrared sensor 122 and/or a gain of the passive infrared sensor 122.

In some implementations, the luminaire 116 can be connected to a building 118 that includes multiple occupants (e.g., persons passing through the building 118) and the luminaire 116 can include a passive infrared sensor that is responsive to body heat from the occupants. The passive infrared sensor can provide signals to a controller or computing device of the luminaire in order for the luminaire 116 to control an output of the luminaire 116 based on the signals. For instance, when a number of occupants has reached a threshold value, the luminaire 116 can either increase or decrease a lumen output of an LED array of the luminaire 116. Such controlled operations can be made possible through processing performed at the remote device 120. For instance, the luminaire 116 can transmit data from the passive infrared sensor to the gateway device 114, which can send the data over the network 112 and to the remote device 120. The metric generation engine 110 can compensate the data using an estimate of ambient temperature in the building 118 and either transmit the compensated data back to the luminaire 116 or generate one or more metrics from the compensated data. In some implementations, a controller of the luminaire 116 can receive the compensated data and determine how to illuminate the building based on the compensated data. In other implementations, the metric generation engine 110 can calculate metrics, such as total occupancy, and transmit the metrics to the luminaire 116 so that the controller of the luminaire 116 can conserve computational resources by not having to calculate such metrics.

In some implementations, multiple luminaires 116 in the building 118 can transmit individual sensor data to the remote device 120 for processing, and the remote device 120 can use the sensor data 106 from the multiple luminaires 116 to calculate certain metrics. For instance, the remote device 120 can individually compensate the sensor data 106 from the luminaires 116 and the metric generation engine 110 can calculate an occupancy distribution from the compensated sensor data. The occupancy distribution can indicate where in the building 118 occupants are located. Occupancy distribution data can be transmitted back to the luminaires 116 so that each luminaire 116 can be aware of where occupants are in the building. In this way, a luminaire 116 can adjust their lumen output according to whether occupants are proximate to the luminaire 116, or moving towards or away from the luminaire 116. It should be noted that the compensated data and the metrics can be generated in real time so that the luminaires can make real-time decisions about how to illuminate areas in the building 118.

Figure 2:
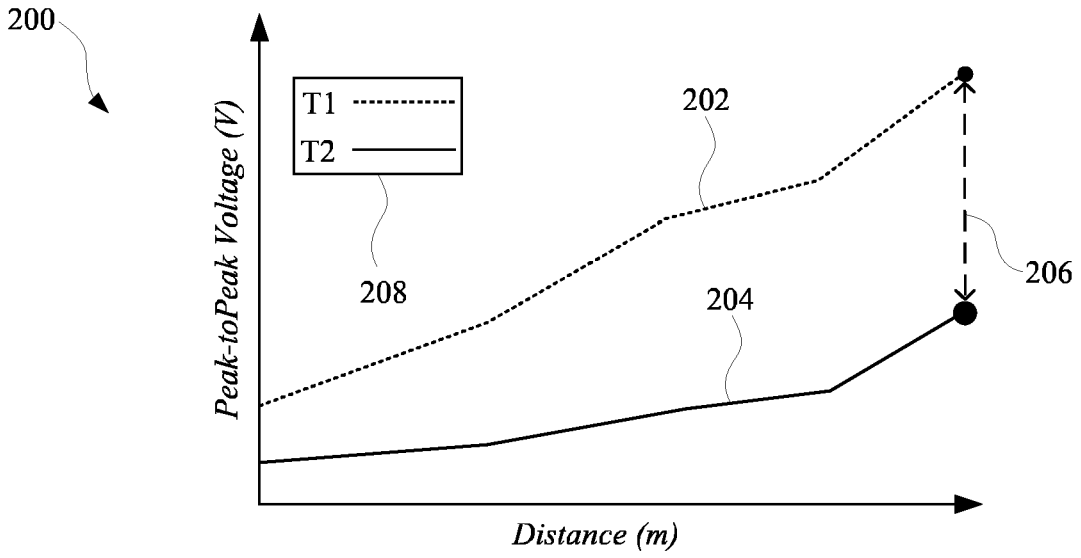
FIG. 2 provides a plot that illustrates how a peak-to-peak voltage of a sensor signal can be affected by a temperature of an environment of the sensor.

FIG. 2 provides a plot 200 that illustrates how a peak-to-peak voltage of a sensor signal can be affected by a temperature at an environment of the sensor. Specifically, plot 200 illustrates a first peak-to-peak voltage 202 corresponding to a sensor signal from a sensor that is operating in an environment having a temperature "T1," (e.g., 1 degree Celsius) as indicated by legend 208. The plot 200 further illustrates a second peak-to-peak voltage 204 corresponding to a different sensor signal from the sensor that is operating in an environment having a temperature "T2," (e.g., 20 degrees Celsius) as also indicated in legend 208. The sensor can be, for example, a passive infrared sensor capable of detecting a presence of a person in an area. Each of the first peak-to-peak voltage 202 and the second peak-to-peak voltage 204 illustrate how the peak-to-peak voltage changes as a distance of the person varies relative to the passive infrared sensor.

Peak-to-peak voltage changes with temperature for passive infrared sensors because the differences in amplitudes of the signals from passive infrared sensors indicate differences in heat detected by the passive infrared sensors. In other words, the amplitude of a signal from a passive infrared sensor can be proportional to a difference between an object's temperature and an ambient temperature of an environment of the object. This temperature dependency of passive infrared sensor can sometimes interfere with the reliability of the signals from the passive infrared sensor. For instance, ambient temperature experienced by the passive infrared sensor can affect the peak-to-peak voltage of the sensor, and, thus, curb the accuracy of the data reported by the passive infrared sensor. As a result, certain metrics, such as occupancy and localization, calculated from the data can be rendered inaccurate. In order to mitigate or eliminate the inaccuracy of some passive infrared sensors, an ambient temperature of the passive infrared sensor can be estimated from available operational data and used to compensate the data from passive infrared sensors, as discussed herein. In this way, more accurate metrics can be used to make decisions about the operations of luminaires or other devices associated with the passive infrared sensors. Furthermore, this method can eliminate the need to add other hardware for measuring ambient temperature, as estimates of ambient temperature can be generated from existing hardware in the luminaires.

For instance, in some implementations passive infrared sensors can be connected to a network of luminaires in a building. One or more of the luminaires can each include a passive infrared sensor for monitoring the movement of people throughout the building. Data related to the operation of LEDs in the luminaires can be used to estimate an ambient temperature affecting each of the luminaires. As the passive infrared sensors of the luminaires are providing analog signals in real-time, the analog signals can be compensated based on the ambient temperature. For example, an analog signal from a luminaire in a room of the building can be compensated according to an estimated ambient temperature in the room. The analog signal can be compensated at the luminaire, at a remote device, and/or at any other processing device capable of receiving signals from the luminaire. The compensated analog signal can then be used by the luminaire or a separate device to make decisions about how to perform. For instance, a third party device, such as an air conditioning unit manufactured by a separate party than the luminaire manufacturer, can use the compensated analog signal to adjust an operation of the air conditioning unit. This allow the air conditioning unit to operate according to a more accurate estimate of occupancy rates, which can affect the heat distribution within the building. For instance, when the compensated analog signal is indicative of a decreasing occupancy rate for the building, the air conditioning unit can modify an operations schedule so that energy is not wasted on cooling the building when less people are in the building.

Figure 3A:
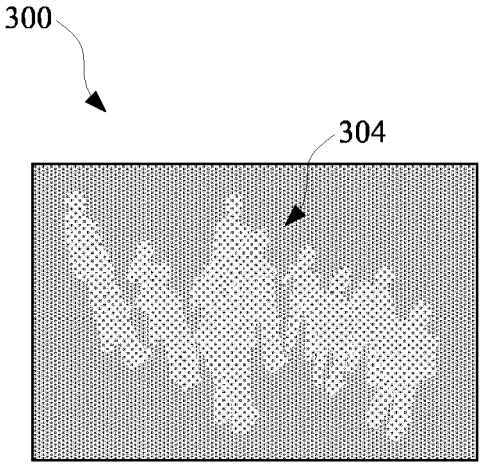
FIGS. 3A and 3B illustrate first data and second data based on uncompensated and compensated analog signal, respectively, from a passive infrared sensor of a luminaire.
Figure 3B:
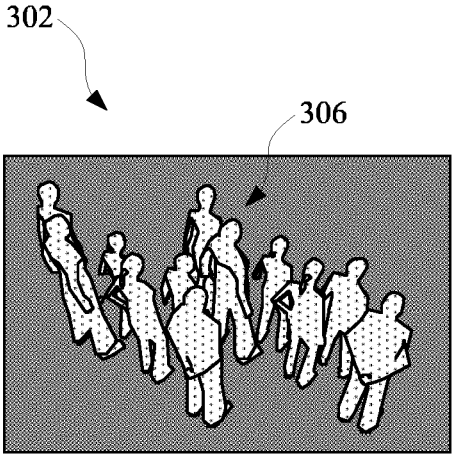

FIGS. 3A and 3B illustrate first data 300 and second data 302 corresponding to uncompensated and compensated analog signal, respectively, from a passive infrared sensor of a luminaire. Specifically, the first data 300 corresponds to a heat map of an area of building where people are gathered. The first data 300 can be compiled from peak-to-peak voltage values collected by the passive infrared sensor. Because the peak-to-peak voltage values represent differences in temperature of the people in the room and the ambient temperature/heat of the room, the first data 300 can provide an indication of the number of people in the room. However, because the first data 300 is based on uncompensated compensated analog signal, an ambiguity 304 can be present in the first data 300. As a result, the ambiguity 304 can render inaccurate any metrics based on the first data 300.

In order to convert the first data 300 into more accurate data, the first data 300 can be compensated with an ambient temperature estimate that is based on certain operating metrics of the luminaire or luminaires that collected the first data 300. For instance, a forward-bias current and/or forward-bias voltage of an LED of the luminaire can be used to generate an estimate of the ambient temperature. The second data 302 can represent the first data 300 after being compensated based on the ambient temperature. As a result of the compensation, the ambiguity 304 from the first data 300 can be converted into a group 306 that can be counted for purposes of determining occupancy, occupancy rates, occupant locations, ad/or any other metric that can be associated with a passive infrared sensor. The group 306 can correspond to a group of people whose heat signature was captured by the passive infrared sensor of the luminaire. Differences between each person in the group 306 can more readily identified from the second data 302 because of the compensation that allowed the differences to be exhibited in the second data 302.

In some implementations, the differences between the first data 300 and the second data 302 can be based on compensated analog signals generated from multiple luminaires that are capturing the heat signatures of the people from different directions. For instance, luminaires can be located on multiple floors of a building, and the passive infrared sensors of some of the luminaires can observe heat signatures in the same location. A luminaire most proximate to the location can be used to gather data for estimating ambient temperature at the location. The ambient temperature experienced by the most proximate luminaire to the location can then be estimated and shared with the surrounding luminaires. The other luminaires observing the location can then compensate the signals from their passive infrared sensors, or cause a remote device to use the ambient temperature estimate to compensate the signals from their passive infrared sensors. The compensated analog signals from the multiple passive infrared sensors can then be analyzed to generate estimates associated with occupancy at the location. This process can be performed over multiple luminaires, in order that an ambient temperature heat map can be compiled for an entire building or other area, such that heat signatures captured at the building or other areas can be more accurate.

Figure 4:
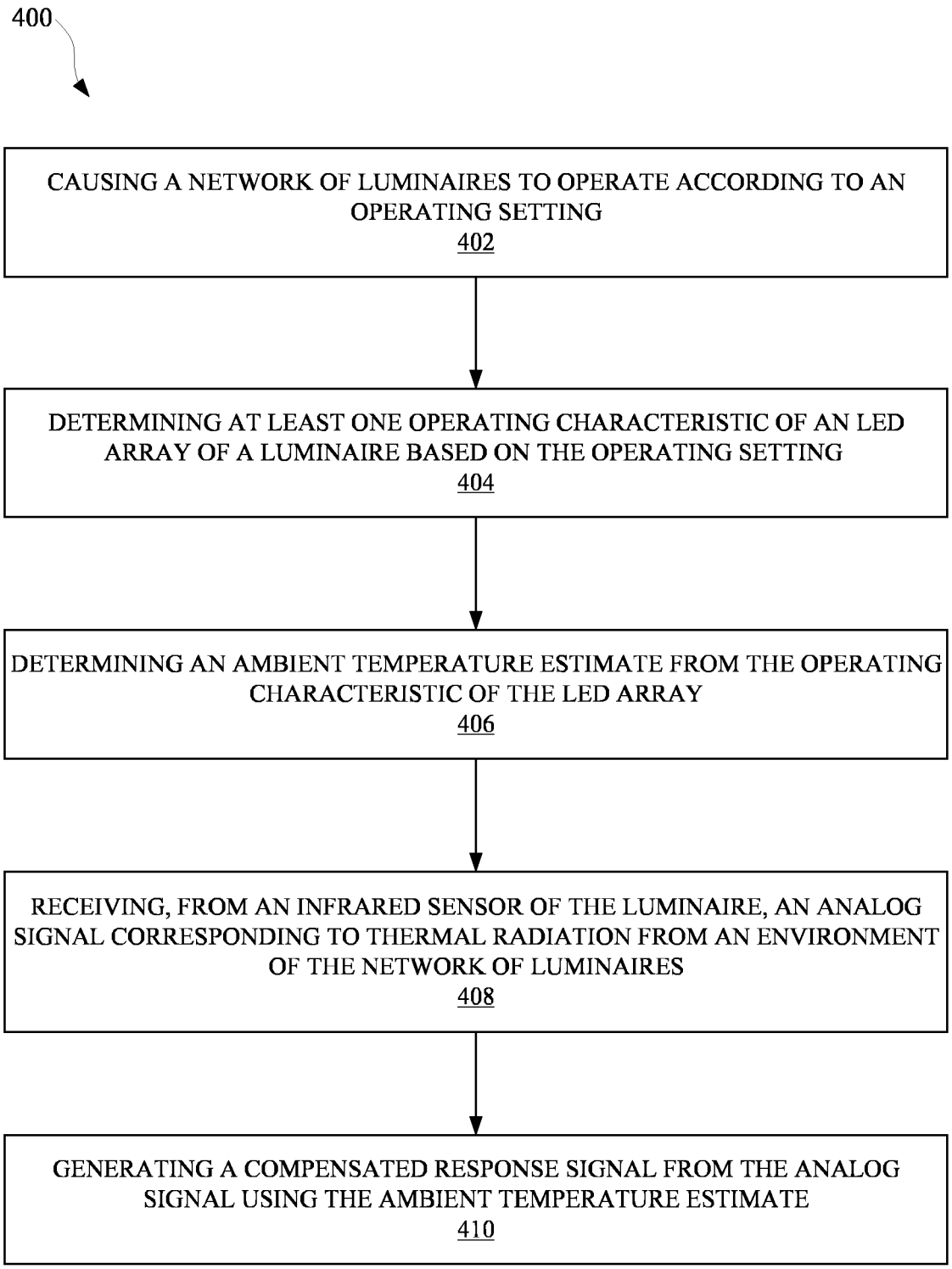
FIG. 4 illustrates a method for compensating a responsive signal from a sensor using an estimate of ambient temperature.

FIG. 4 illustrates a method 400 for compensating a responsive signal from a sensor using an estimate of ambient temperature. The method 400 can be performed by a computing device, controller, and/or any other apparatus capable of analyzing sensor signals. The method 400 can include a block 402 of causing a network of luminaires to operating according to an operating setting. The network of luminaires can be one or more luminaires connected within a location such as a building, power grid, and/or any other location capable of supporting a network of luminaires. The operating setting can be any setting from which a luminaire can operate such as, for example, a dimming level. The dimming level can control and/or indicate a brightness or luminance of a luminaire and can influence an amount of power being used by the luminaire. In some implementations, the operating setting can be a current, power, and/or voltage setting for one or more luminaires of the network of luminaires. The operating setting can be adjusted in order to accommodate people that may be moving through a location, or otherwise to provide light for a particular purpose.

The method 400 can include a block 404 of determining at least one operating characteristic of an LED array of a luminaire in the network of luminaires based on the operating setting. An operating characteristic of the luminaire can include a forward-bias current, a forward-bias voltage, a power consumption, a nominal current, a nominal voltage, and/or any other operating specification that can be associated with a device. The operating characteristic and/or the operating setting can be used to generate an environmental metric from which a sensor signal can be compensated. For instance, the operating characteristic and/or the operating setting can be used to generate an ambient temperature estimate, which can be used to compensate temperature related sensor signals, such as a passive infrared sensor signal.

The method 400 can include a block 406 of determining an ambient temperature estimate from the operating characteristic of the LED array of the luminaire. In some implementations, the operating characteristic is a forward-bias current or a forward-bias voltage of one or more LEDs of the LED array. The operating characteristic can be measured by a component of the luminaire, or gleaned from multiple components operating within the luminaire. The operating characteristic can be measured in real time in order that signal compensation can also be performed in real time, or with minimal latency.

The method 400 can include a block 408 of receiving, from an infrared sensor of the luminaire, a signal (e.g., an analog or digital signal) corresponding to thermal radiation from an environment of the network of luminaires. The environment can include one or more persons emitting some amount of body heat that can captured by the passive infrared sensor. Therefore, the signal received from the infrared sensor of the luminaire can be in response to body heat being emitted by people located near the infrared sensor. In some implementations, block 408 can include receiving multiple different signals from luminaires in the network of luminaires that also include infrared sensors for detecting thermal radiation.

The method 400 can further include a block 410 of generating a compensated response signal from the received signal using the ambient temperature estimate. The compensated response signal can be generated by converting the ambient temperature estimate into a voltage value or other data value that can be deducted or otherwise used to balance the received signal. In some implementations, the received signal can be analyzed to find voltage values that are most similar to the converted ambient temperature value in order that the identified voltage values can be modified to accent features in the received signal that stand out from the ambient temperature. For instance, a person's body heat can be different from the ambient temperature, therefore, identifying the ambient temperature can allow for more accurate occupancy metrics to be generated. When analog signal data is discarded or other filtered out (e.g., converted to digital), such occupancy metrics may end up being less accurate. Therefore, the method 400 can provide more accurate data by keeping the analog response data and incorporating compensation based on an ambient temperature estimate.

Figure 5:
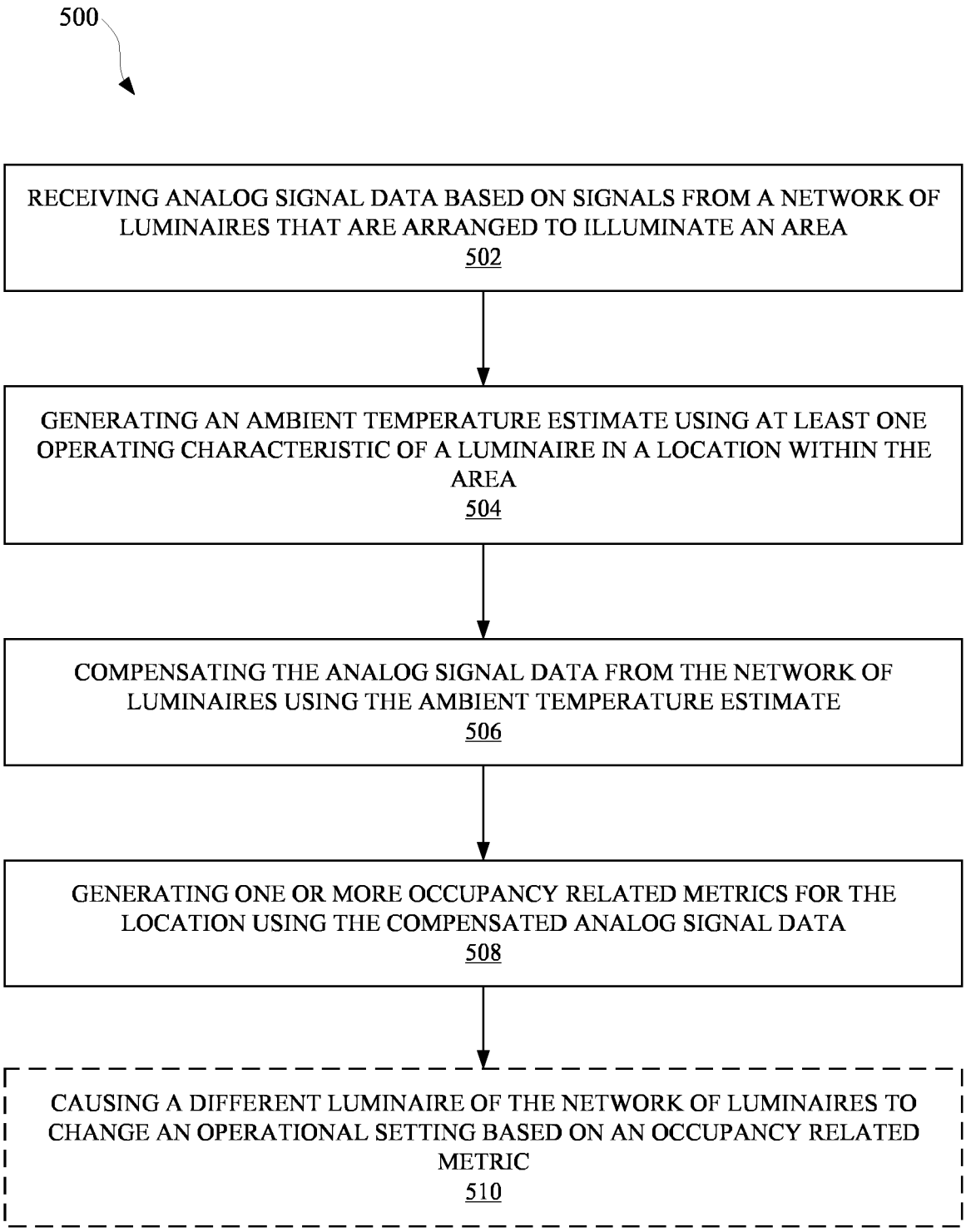
FIG. 5 illustrates a method for operating a network of luminaires according to an ambient temperature estimate generated from an operating characteristic of at least one luminaire in the network of luminaires.
Figure 6:
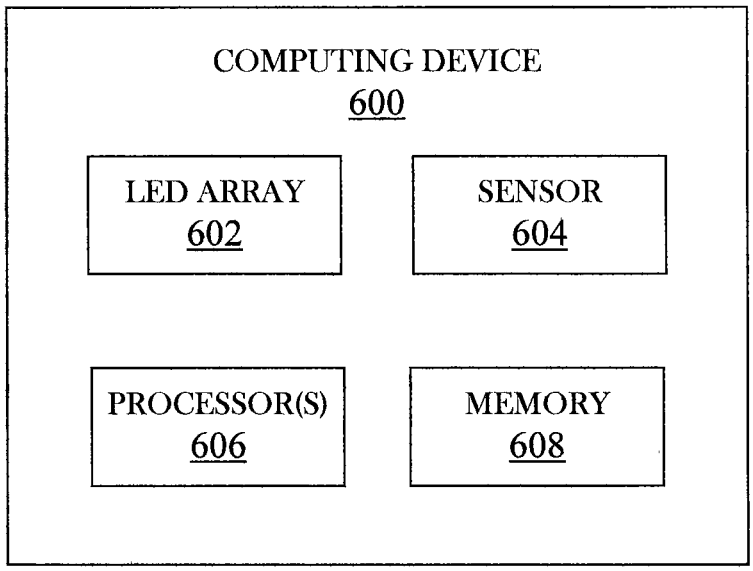
FIG. 6 illustrates a computing device in accordance with an exemplary implementation.

FIG. 5 illustrates a method 500 for operating a network of luminaires according to an ambient temperature estimate generated from an operating characteristic of at least one luminaire in the network of luminaires. The method 500 can be performed by a computing device, controller, and/or any other device capable of providing a signal to a luminaire. The method 500 can include a block 502 of receiving analog signal data that is based on signals from a network of luminaires that are arranged to illuminate an area. The area can be, for example, a room in a building, or an area that is otherwise subject to occupancy changes. The analog signal data can be generated from sensors that are individually connected to a luminaire of the network of luminaires. The sensors can include a temperature sensor, infrared sensor, video sensor, touch sensor, and/or any other sensor that can be affected by changes in temperature. The analog signal data can be received by a luminaire in the network of luminaires, or a remote device, such as a server, capable of analyzing the analog signal data from the luminaires.

The method 500 can include a block 504 of generating an ambient temperature estimate using at least one operating characteristic of a luminaire within the area. The operating characteristic can be any variable that can affect or otherwise influence an operation of the luminaire. For instance, in some implementations the operating characteristic can be a forward-bias current and/or a forward-bias voltage of one or more LEDs in the luminaire. In some implementations, the operating characteristic can be an estimated temperature of a component of the luminaire, such as a heat sink component. The ambient temperature estimate can be generated from one or more operating characteristic values, as discussed herein.

The method 500 can include a block 506 of compensating the analog signal data from the network of luminaires using the ambient temperature estimate. The compensated analog signal data can be based on the analog signal data from multiple luminaires and the ambient temperature estimate associated with a single luminaire. For instance, the single luminaire can be at a location that is also being observed by passive infrared sensors of other luminaires. Therefore, the sensor signals from the passive infrared sensors of the other luminaires can benefit from compensation based on the ambient temperature estimate associated with the observed location.

The method 500 can further include a block 508 of generating one or more occupancy related metrics for the location using the compensated analog signal data. The occupancy related metrics can include a total occupancy, an occupancy rate, a noise level, an average occupancy, a predicted occupancy, and/or any other metric that can be associated with occupancy. In some implementations, occupancy can be determined through one or more image processing algorithms capable of segmenting individuals in heat map data and counting the individuals in order to generate an estimate of occupancy in an area.

The method 500 can include an optional block 510 of causing a different luminaire of the network of luminaires to change an operational setting based on an occupancy related metric. For instance, a total occupancy for the area can be calculated from the compensated analog signal data. The total occupancy can be transmitted from a luminaire, or a remote device, to other luminaires in the network of luminaires and/or to other devices in the area. In this way, the luminaires and/or other devices can use the totally occupancy value to adjust operations or settings. For instance, the area illuminated by the luminaires can include graphic displays, and the graphic displays can change according to how many people are in the area. Alternatively, the luminaires can change their dimming level setting according to the total occupancy of the area.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of" when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

The invention claimed is:

1. A method for compensating analog signal data, the method comprising:

causing, by one or more processors, one or more luminaires to operate according to an operating setting, wherein a given luminaire of the one or more luminaires includes a light emitting diode (LED) array and a passive infrared sensor;

determining, by the one or more processors, at least one operating characteristic of the LED array at least based on the operating setting of the given luminaire;

determining, by the one or more processors, a temperature estimate from the at least one operating characteristic of the LED array, wherein the temperature estimate is associated with an environment of the one or more luminaires;

receiving, by the one or more processors, and from the passive infrared sensor of the given luminaire, an analog signal corresponding to thermal radiation from the environment of the one or more luminaires;

generating, by the one or more processors, a compensated response signal from the analog signal using the temperature estimate; and operating the one or more luminaires based on the compensated response signal.

2. The method of claim 1, wherein the temperature estimate corresponds to an ambient temperature of the environment and the method further comprises:

determining an estimate of a number of occupants in the environment from the compensated response signal.

3. The method of claim 1, wherein the at least one operating characteristic is a real-time measurement of power consumption of the LED array.

4. The method of claim 3, wherein determining the at least one operating characteristic includes determining an LED junction temperature for the LED array.

5. The method of claim 4, wherein the at least one operating characteristic is a real-time measurement of thermal resistance at a heat sink of the given luminaire.

6. The method of claim 1, further comprising:

causing a separate passive infrared sensor of a different luminaire to be calibrated based on the temperature estimate.

7. A system for compensating analog signal data, the system comprising:

one or more luminaires; and a computing device comprising one or more processors, and memory configured to store instructions that, when executed by the one or more processors, cause the one or more processors to perform steps that include:

receiving operating characteristic data from a given luminaire of the one or more luminaires, wherein the operating characteristic data includes a variable that is different than temperature;

receiving analog signal data from one or more passive infrared sensors connected to the one or more luminaires;

generating an estimate of ambient temperature from at least the operating characteristic data, wherein the estimate of ambient temperature is associated with an environment of the one or more luminaires; and operating at least one of the one or more luminaires based on a compensated analog signal data that is generated from the received analog signal data and the estimate of ambient temperature.

8. The system of claim 7, wherein the steps further include:

determining an estimate of occupancy of an area associated with the ambient temperature using the compensated analog signal data.

9. The system of claim 7, wherein the operating characteristic data is a forward-bias voltage of a light emitting diode (LED) array of the one or more luminaires.

10. The system of claim 7, wherein the steps further include:

generating, based on the compensated analog signal data, an estimate of occupancy rate, occupancy total, or occupancy distribution for an area illuminated by the one or more luminaires.

11. The system of claim 10, wherein the one or more luminaires comprises a network of luminaires that is operated further based on the occupancy rate, the occupancy total, or the occupancy distribution of the area illuminated by the network of luminaires.

12. A computing device, comprising:

a light emitting diode (LED) array;

a sensor configured to provide an analog response signal;

one or more processors; and memory configured to store instructions that, when executed by the one or more processors, cause the one or more processors to perform steps that include:

generating the analog response signal according to an external stimulus from an environment of the LED array;

determining one or more operating characteristics of the LED array, wherein the one or more operating characteristics is associated with a luminance of the LED array;

generating an estimate of an environmental metric based on at least an operating characteristic, wherein the environmental metric is an ambient temperature that is associated with the environment of the LED array;

generating a compensated analog response signal based on the estimate of the environmental metric; and modifying the one or more operating characteristics at least based on the compensated analog response signal.

13. The computing device of claim 12, wherein the one or more operating characteristics include at least a dimming level of the LED array.

14. The computing device of claim 12, wherein the one or more operating characteristics includes a forward-bias voltage or a forward-bias current of the LED array.

15. The computing device of claim 12, wherein the external stimulus includes infrared radiation from one or more occupants of the environment illuminated by the LED array.

* * * * *